US007025439B2

(12) United States Patent
Laurer et al.

(10) Patent No.: US 7,025,439 B2
(45) Date of Patent: Apr. 11, 2006

(54) INK JET PRINTER WITH EXTENDED NOZZLE PLATE AND METHOD

(75) Inventors: Jonathon Harold Laurer, Lexington, KY (US); Paul Timothy Spivey, Lexington, KY (US); Melissa Marie Waldeck, Lexington, KY (US); John Thomas Warren, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/800,989

(22) Filed: Mar. 15, 2004

(65) Prior Publication Data

US 2005/0200660 A1 Sep. 15, 2005

(51) Int. Cl.
*B41J 2/14* (2006.01)

(52) U.S. Cl. ..... 347/47

(58) Field of Classification Search ..... 347/20, 347/44, 47, 50, 54–59, 61–63
See application file for complete search history.

(56) References Cited

U.S. PATENT DOCUMENTS 4,633,274 A 12/1986 Matsuda
5,300,959 A 4/1994 McClelland et al.
5,434,607 A * 7/1995 Keefe ..... 347/50
5,538,586 A 7/1996 Swanson et al.
6,024,440 A * 2/2000 Murthy et al. ..... 347/65
6,328,423 B1 12/2001 Wong et al.
6,364,475 B1 4/2002 Feinn et al.
6,386,434 B1 5/2002 Wong
6,387,465 B1 5/2002 Yuan et al.
2003/0081090 A1 5/2003 Erickson et al.

FOREIGN PATENT DOCUMENTS

JP 61125852 6/1986

* cited by examiner

*Primary Examiner*—Stephen Meier
*Assistant Examiner*—An H. Do
(74) *Attorney, Agent, or Firm*—Ludeka, Neely & Graham P.C.

(57) ABSTRACT

The invention provides a micro-fluid ejection head for a micro-fluid ejection device and a method for making a micro-fluid ejection head. The micro-fluid ejection head includes a semiconductor substrate containing fluid ejection devices electrically connected to contact pads on a surface thereof. A TAB circuit including lead beams is electrically connected to the contact pads on the semiconductor substrate surface. A nozzle plate structure is provided and installed relative to the TAB circuit so as to substantially cover the lead beams and contact pads in order to protect the lead beams and contact pads from exposure to fluid ejected by the micro-fluid ejection device. The micro-fluid ejection head is effective to reduce contact between electrical components and the fluid without the use of a separate encapsulant material.

10 Claims, 8 Drawing Sheets

INK JET PRINTER WITH EXTENDED NOZZLE PLATE AND METHOD

FIELD OF THE INVENTION

The invention relates to micro-fluid ejection devices. More particularly, the invention relates to improved nozzle plates for micro-fluid ejection devices such as for printheads and to methods for making micro-fluid ejection devices incorporating such nozzle plates.

BACKGROUND

The primary components of ink jet printheads are a semiconductor chip, a nozzle plate, and a flexible TAB circuit attached to the chip. The semiconductor chip is preferably made of silicon and contains various passivation layers, conductive metal layers, resistive layers, insulative layers and protective layers deposited on a device side thereof. For thermal ink jet printers, individual heater resistors are defined in the resistive layers and each heater resistor corresponds to a nozzle hole in the nozzle plate for heating and ejecting ink toward a print media.

Typically, the chip is mounted to a printhead body within a chip window on a flexible TAB circuit. The TAB circuit attaches to a print head body and provides electrical contact pads for connecting to corresponding contacts in the ink jet printer. The TAB circuit includes many closely-spaced electrically-conductive traces that connect the print head chip to the contact pads. Typically, metal leads span the chip window to connect the traces to connection points on the chip. The metal leads and connection points on the chip are susceptible to mechanical damage during the manufacture of the printhead and during normal use of the printhead. The metal leads are also susceptible to corrosion damage from exposure to ink once the printhead has been installed on a printer.

For example, with regard to corrosive damage, ink supply channels within the chip receive ink from an ink reservoir in the print head cartridge. Through capillary action, the ink flows into the channels and is provided to ink ejection elements on the chip. The ink-ejection elements are selectively activated to cause ejection of ink droplets toward a print medium. Due to the close proximity of the chip to the source of the ink, and due to the low viscosity of the ink, the ink tends to flow around the edges of the chip and come in contact with the leads and the traces. Many formulations of ink are somewhat conductive and corrosive. When a space between two leads of a TAB circuit is filled with such ink, and an electrical potential exists between the leads, an electrical current may flow through the ink from one lead to the other. This current flow causes electrochemical corrosion of the source lead, that is, the lead that is the source of the current flow. The corrosion narrows the lead over time, and eventually corrodes the lead completely through, rendering the print head chip partially or completely inoperable.

Conventionally, an encapsulant is used in an effort to protect the leads from mechanical and corrosion damage. However, improvement is desired in the construction of printheads, particularly in regard to protection of the leads from mechanical and corrosive damage.

SUMMARY OF THE INVENTION

In one embodiment, the invention relates to a micro-fluid ejection device such as a printhead for an ink jet printer and to methods for making printheads which eliminate the dependency on and the use of an encapsulant to protect the electrical leads.

In one embodiment, the invention provides a micro-fluid ejection device. The micro-fluid ejection device includes a fluid ejection chip having a first length and a first width and having a first side and a second side. The first side of the chip includes a plurality of fluid ejection actuators and a plurality of bond pads. A flexible circuit having a first side and a second side, a window therein, and leads disposed in the window is also provided. The window of the flexible circuit circumscribes the chip and each of the leads is electrically connected to corresponding bond pads on the first side of the chip. A nozzle plate structure having a second length and a second width and containing a plurality of nozzle holes is attached to the flexible circuit and the chip. The nozzle plate structure overlaps the first side of the chip and at least the leads and bond pads and is effective to retard fluid contact with the bond pads and leads in the absence of an encapsulant.

In another embodiment, the invention provides a method for making a printhead for an inkjet printer. The method includes the steps of providing a fluid ejection chip having a first length and a first width and having a first side and a second side. The first side of the chip includes a plurality of fluid ejection actuators and a plurality of bond pads. A flexible circuit having a first side and a second side, a window therein is provided. Leads are disposed in the window, and the window of the flexible circuit is sized to circumscribe the chip. A nozzle plate containing a plurality of nozzle holes is provided, wherein the nozzle plate is dimensioned slightly smaller than the chip. The nozzle plate is attached to the chip to provide a nozzle/plate chip assembly. The nozzle plate/chip assembly is then attached to the TAB circuit, wherein each of the leads is electrically connected by a TAB bonding process to corresponding bond pads on the first side of the chip. A secondary plate having a window sized to closely surround the nozzle plate is provided. The secondary plate is attached to the first side of the flexible circuit such that the secondary plate overlaps the first side of the chip and at least the leads and bond pads and is effective to retard fluid contact with the bond pads and leads in the absence of an encapsulant.

Yet another aspect of the invention provides a method for making a printhead for an inkjet printer. The method includes the steps of providing a semiconductor substrate having a nozzle plate attached thereto. A TAB circuit having lead beams is also provided. The lead beams are electrically connected to the TAB circuit. A plate structure is provided and installed relative to the TAB circuit so as to substantially cover the lead beams to protect the lead beams from exposure to ink.

In various embodiments described herein, the invention advantageously enables printheads that can be produced without the need for an encapsulant to protect the lead beams. Despite the substantial absence of encapsulant, the printheads and methods therefor are effective to reduce corrosion of electrical leads and contacts thereon.

Another advantage of the invention is that printheads having the substantial absence of encapsulant exhibit improved function with respect to taping the printhead for shipping purposes. Specifically, there is no encapsulant to interfere with applying the shipping tape to the nozzle plate or to interfere with the tape's ability to adequately seal the nozzle holes.

Another advantage of a printhead made according to the invention is improvement in maintenance activities directed to cleaning the printhead. The absence of encapsulant allows for more reliable maintenance of the printhead by a wiper. More reliable maintenance provides increased print quality over the life of the printhead. This absence of an encapsulant also greatly reduces the sound generated by the wiper during a maintenance cycle for the printhead. Absence of the encapsulant also reduces the evaporation rate of the ink through the nozzle holes when the printhead is capped in a capping station of the printer. The reduced evaporation rate through the nozzle holes enables increased ink yield per printhead.

Finally a printhead made according to the invention exhibits improved print quality by eliminating a primary source of ink smear on a printed media. Printheads containing an encapsulant have encapsulant material protruding beyond the nozzle plate which may contact the print media during a printing operation thereby causing ink smearing on the media.

BRIEF DESCRIPTION OF THE DRAWINGS

Further features and advantages of the invention will become apparent by reference to the detailed description when considered in conjunction with the figures, which are not to scale, wherein like reference numbers indicate like elements through the several views, and wherein.

DETAILED DESCRIPTION OF CERTAIN EMBODIMENTS OF THE INVENTION

The present invention relates to a micro-fluid ejection device and to methods for making such a device. The device includes a nozzle plate configured in dimension to overly and thereby protect portions of electrical leads which extend between a semiconductor substrate portion, e.g., which extend between an "ejection device chip," and a TAB circuit or flexible circuit. Conventionally, the chip is placed within a chip window of the TAB circuit and a space or gap between the TAB circuit and the chip remains exposed. An encapsulant material, typically UV or thermally cured adhesives, is dispensed into the gap and over the leads. According to certain embodiments, the invention advantageously enables micro-fluid ejection device structures which protect the leads even in the absence of the use of an encapsulant, thus enabling the application of an encapsulant to be omitted if desired while providing suitable protection of leads and contacts from mechanical damage and corrosion.

Figure 1:
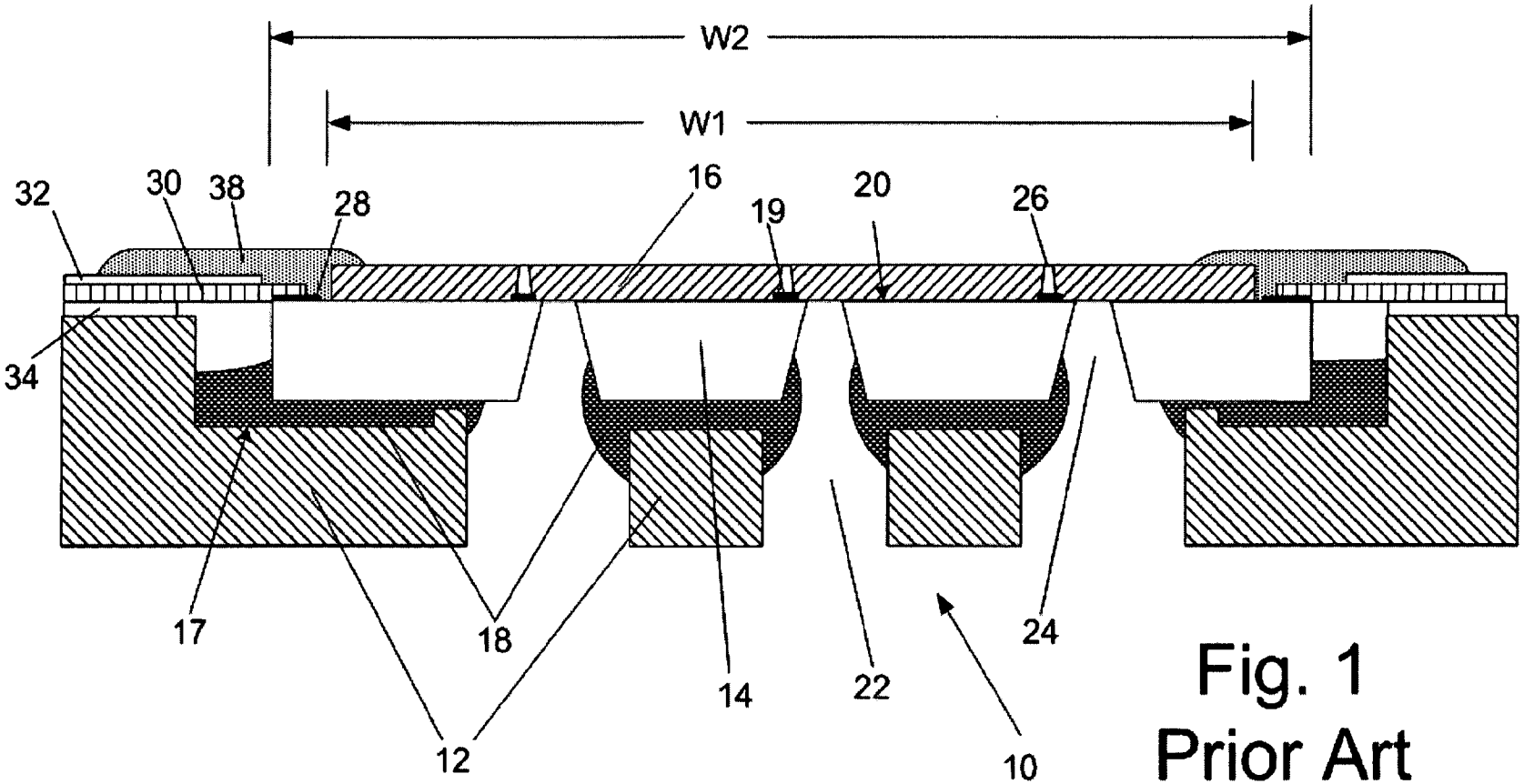
Fig. 1 Prior Art
FIG. 1 is a cross-sectional view, not to scale, of a portion of a prior art printhead.
Figure 2:
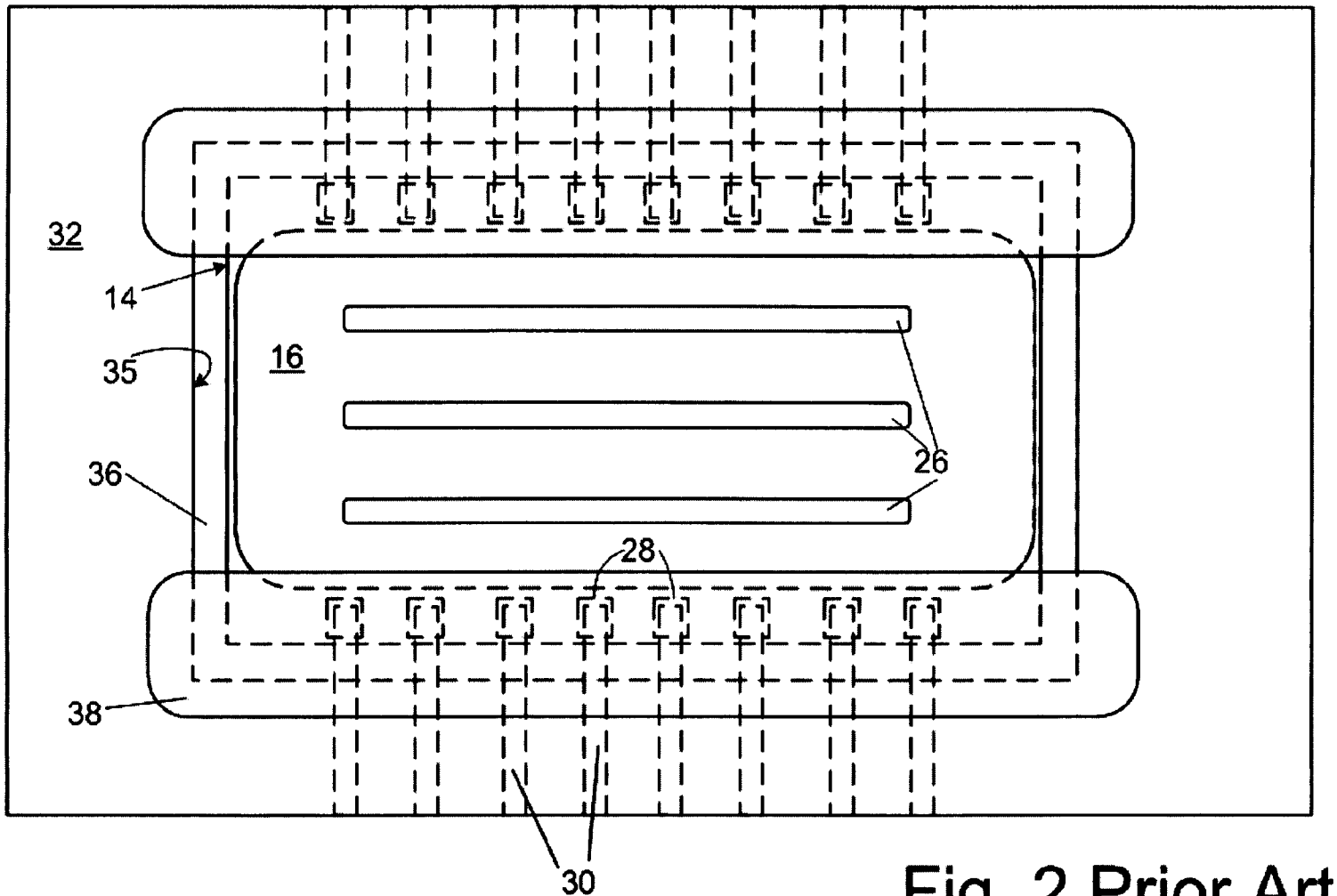
Fig. 2 Prior Art
FIG. 2 is a top plan view of the printhead of FIG. 1.

Prior Art (FIGS. 1–2)

With reference to FIG. 1, there is shown a representation of a portion of an ink jet printhead 10 viewed in cross-section, not to scale, showing a printhead body 12 having a semiconductor substrate 14 attached to the body in a chip pocket 17 and a nozzle plate 16 attached to the substrate 14. The nozzle plate 16 is substantially the same or slightly smaller at least in width (W1) to a width (W2) of the semiconductor substrate 14 and is attached to the semiconductor substrate 14 using an adhesive such as a phenolic butyral adhesive. The substrate/nozzle plate assembly 14/16 is attached in the chip pocket 17 in the printhead body 12, as by adhesive 18, such as a die bond adhesive, to form the printhead 10. Ink is supplied to the substrate/nozzle plate assembly 14/16 from an ink reservoir in the printhead body generally opposite the chip pocket 17.

The semiconductor substrate 14 is typically a silicon semiconductor substrate containing a plurality of ejection devices 19 such as piezoelectric devices or heater resistors formed on a device side 20 thereof. Upon activation of the heater resistors 19, ink supplied through ink paths 22 in the body 12 and corresponding ink vias 24 in the semiconductor substrate 14 is caused to be ejected toward a print media through nozzle holes 26 in the nozzle plate 16. The nozzle plate 16 is typically made from a polyimide film or metal.

With additional reference to FIG. 2, electrical tracings (not shown) extend from the ink ejection devices 19 (FIG. 1) on the substrate 14 to contact pads 28 located on the surface 20 of the substrate 14. Lead beams 30 electrically connect the contact pads 28 to a flexible circuit or a tape automated bonding (TAB) circuit 32 (FIG. 1) for supplying electrical impulses from a printer controller to activate one or more of the ink ejection devices on the substrate 14. The TAB circuit 32 is attached to the printhead body 12 as by a pressure sensitive adhesive 34 (FIG. 1) or other suitable adhesive.

As will be noted, the TAB circuit 32 has an interior portion thereof cutaway to define a chip window 35 which surrounds the substrate/nozzle plate assembly 14/16. As the window 35 is slightly larger in dimension than the substrate 14, a gap 36 is defined between the common edges of the substrate 14 and the inner periphery of the TAB circuit 32 defining the window 35, with the edges of the nozzle plate lying within or closely adjacent to the edges of the semiconductor substrate 14 so as to not extend into the gap 36. An encapsulant 38 is dispensed to span portions of the gap 36 to protect the lead beams 30, exposed edges of the TAB circuit 32 and contact pads 28.

In order to construct the ink jet printhead 10 described above, the nozzle plate 16 is first attached to the substrate 14. The TAB circuit 32 is electrically connected to the substrate/nozzle plate assembly 14/16. The TAB circuit/substrate/nozzle plate assembly 14/16/32 is then adhesively attached to the printhead body 12 with the die bond adhesive 18 and the pressure sensitive adhesive 34. Finally, the encapsulant material 38 is applied to the contact pads 28 and lead beams 30.

FIGS. 3–5

The invention, as set forth herein, uses novel nozzle plate structures and configurations to span the gap between the semiconductor substrate and the TAB circuit, thereby eliminating exposure of the leads and the need for an encapsulant.

Figure 3:
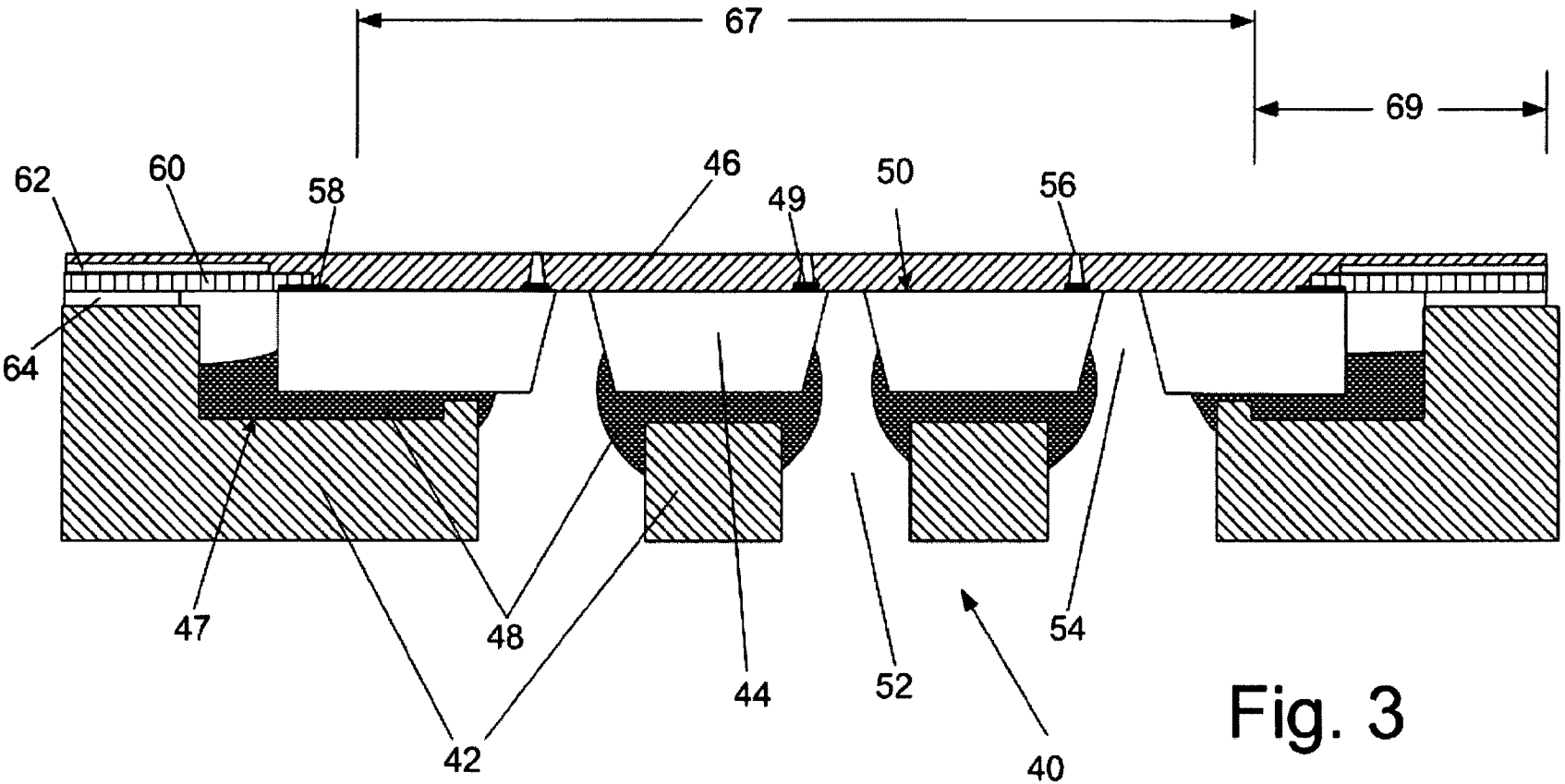
FIG. 3 is a cross-sectional view, not to scale, of a portion of a printhead according to an exemplary embodiment of the invention.
Figure 4:
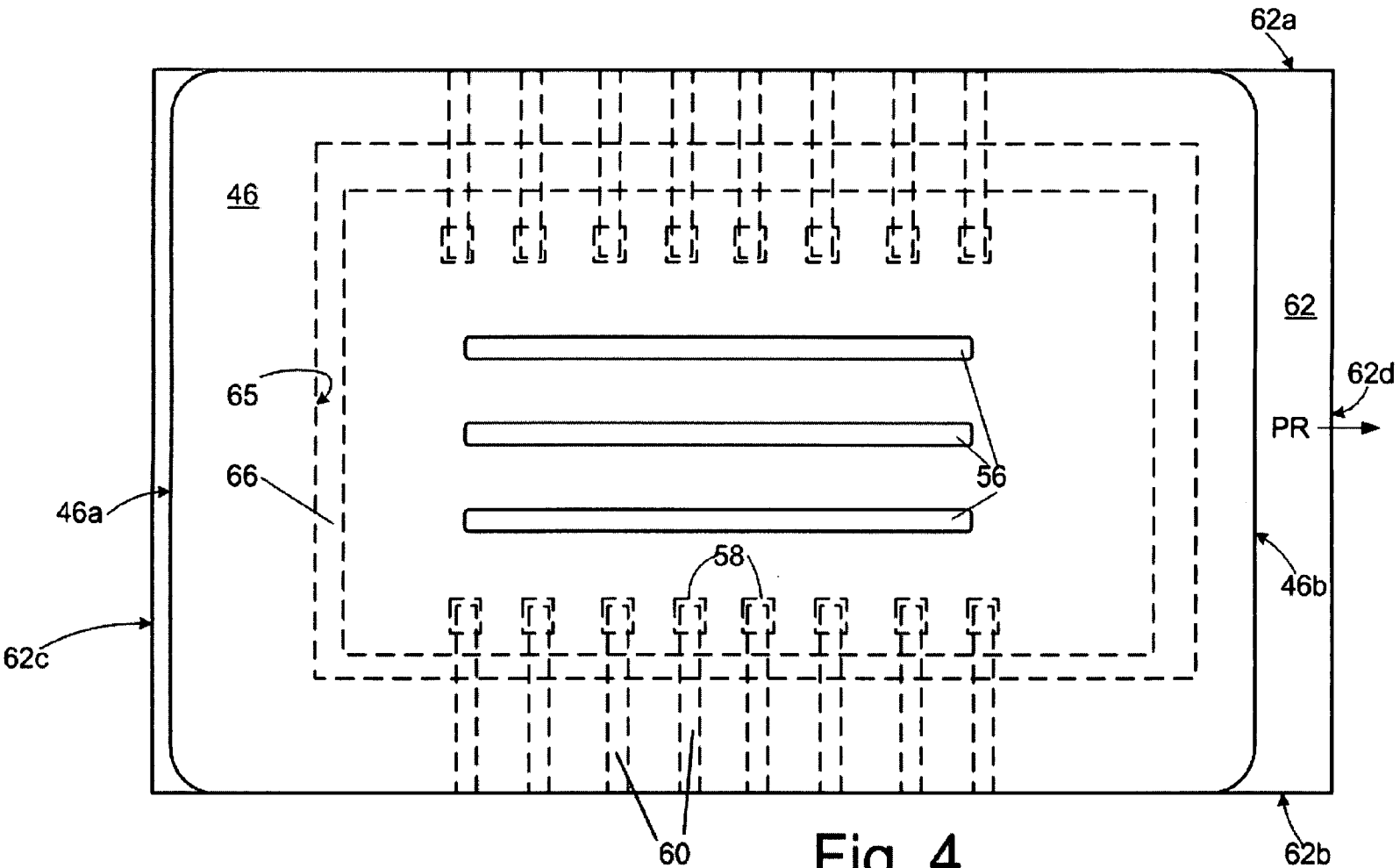
FIG. 4 is a top plan view, not to scale, of the printhead of FIG. 3.

With reference to FIGS. 3 and 4, there is shown a representative portion of an ink jet printhead 40 in accordance with an exemplary embodiment of the invention as viewed in cross-section, not to scale. The printhead 40 includes a printhead body 42, a semiconductor substrate 44, and a nozzle plate structure 46. The nozzle plate structure 46 is attached to the semiconductor substrate 44 using an adhesive such as a phenolic butyral adhesive to provide a substrate/nozzle assembly 44/46. The substrate/nozzle plate assembly 44/46 is attached in a chip pocket 47 in the printhead body 42, as by adhesive 48, such as a die-bond adhesive, to form the printhead 40. Ink is supplied to the substrate/nozzle plate assembly 44/46 from an ink reservoir in the printhead body generally opposite the chip pocket 47.

The semiconductor substrate 44 is preferably a silicon semiconductor substrate containing a plurality of fluid ejection devices 49 such as piezoelectric devices or heater resistors formed on a device side 50 thereof. Upon activation of the fluid ejection devices 49, a fluid such as ink supplied through paths 52 in the body 42 and corresponding vias 54 in the semiconductor substrate 44 is caused to be ejected toward a fluid receiving media through nozzle holes 56 in the nozzle plate structure 46.

The nozzle plate structure 46 is made from a relatively thin polyimide film which may contain an ink repellent coating on a surface thereof and an adhesive on the other side thereof for bonding the nozzle plate structure 46 to the substrate 44. The film is preferably either about 25 or about 50 microns thick and the adhesive is about 2–12 microns thick. The thickness of the film is fixed by the manufacturer thereof. In one embodiment, the flow features, e.g., nozzles and other flow features are preferably formed in the film, as by laser ablation or they may be formed in a separate thick film layer attached to the device side 50 of the chip.

With additional reference to FIG. 4, electrical tracings extend from the ejection devices 49 of the substrate 44 to contact pads 58 located on the surface 50 of the substrate 44. Lead beams 60 electrically connect the contact pads 58 to a flexible circuit or a tape automated bonding (TAB) circuit 62 for supplying electrical impulses from a printer controller to activate one or more of the ejection devices 49 on the substrate 44. The TAB circuit 62 is attached to the printhead body 42 as by a pressure sensitive adhesive 64 and includes a cutout portion to define a window 65 (FIG. 4) for receiving the substrate 44 (FIG. 3). As the window 65 is dimensioned slightly larger than the substrate 44, a gap 66 is defined between the common edges of the substrate 44 and the inner periphery of the TAB circuit 62 defining the window 65. However, in accordance with an exemplary embodiment of the invention, the nozzle plate structure 46 is advantageously dimensioned to extend across the gap 66 between the semiconductor substrate 44 and the TAB circuit 62.

In this regard, the nozzle plate structure 46 may preferably be configured to include a nozzle plate portion 67 and a protection plate portion 69 wherein the protection plate portion 69 extends across the portion of the gap 66 adjacent the lead beams 60 and, most preferably, the entire gap 66. To accomplish this, the nozzle plate 46 may be dimensioned in width to substantially correspond to the width of the TAB circuit 62 and thus extend substantially to edges 62*a* and 62*b* of the TAB circuit 62. Likewise, the nozzle plate 46 is preferably dimensioned in length to have an end 46*a* which extends substantially to an end 62*c* of the TAB circuit 62. Opposite end 46*b* of the nozzle plate 46 extends closely adjacent the opposite end 62*d* of the TAB circuit 62, but spaced slightly therefrom so as to not interfere with an adjoining pad region of the circuit 62, identified generally by arrow PR, which wraps over an edge of the body 42 to provide contact pads for connection to an ejector activating device such as a printer.

As will be observed, the thus configured nozzle plate structure 46 also overlies the lead beams 60. It has been observed that provision of a nozzle plate structure 46 of this configuration and located so as to overlie the lead beams 60 satisfactorily protects the lead beams and eliminates the need for an encapsulant such as the encapsulant 38 described previously in connection with prior art devices (FIGS. 1 and 2). The use of nozzle plate structures such as the nozzle plate structure 46 also advantageously enables economy of the manufacturing process.

Figure 5:
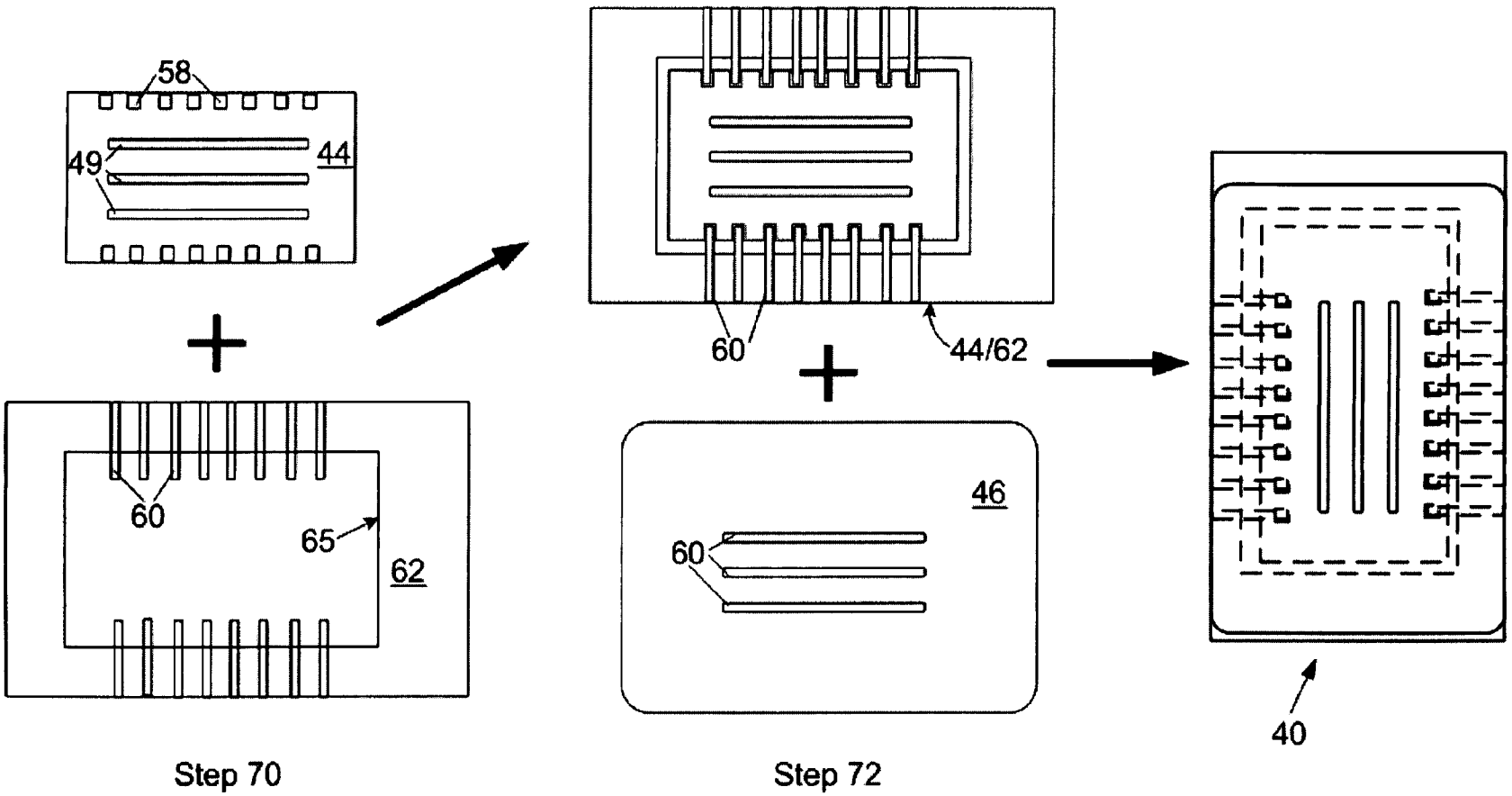
FIG. 5 illustrates steps in a manufacturing process for the printhead of FIG. 3.

For example, with reference to FIG. 5, there are shown steps in the manufacture of the printhead 40, wherein the need for an encapsulant deposition step is eliminated. In a first step 70, the TAB circuit 62 is bonded to the semiconductor substrate 44 to provide a substrate-circuit assembly 44/62. Next, in step 72, the nozzle plate structure 46 is bonded to the assembly 44/62 to yield the printhead 40. As will be appreciated, this enables elimination of a step wherein an encapsulant is dispensed over the lead beams 60.

FIGS. 6–7

Figure 6:
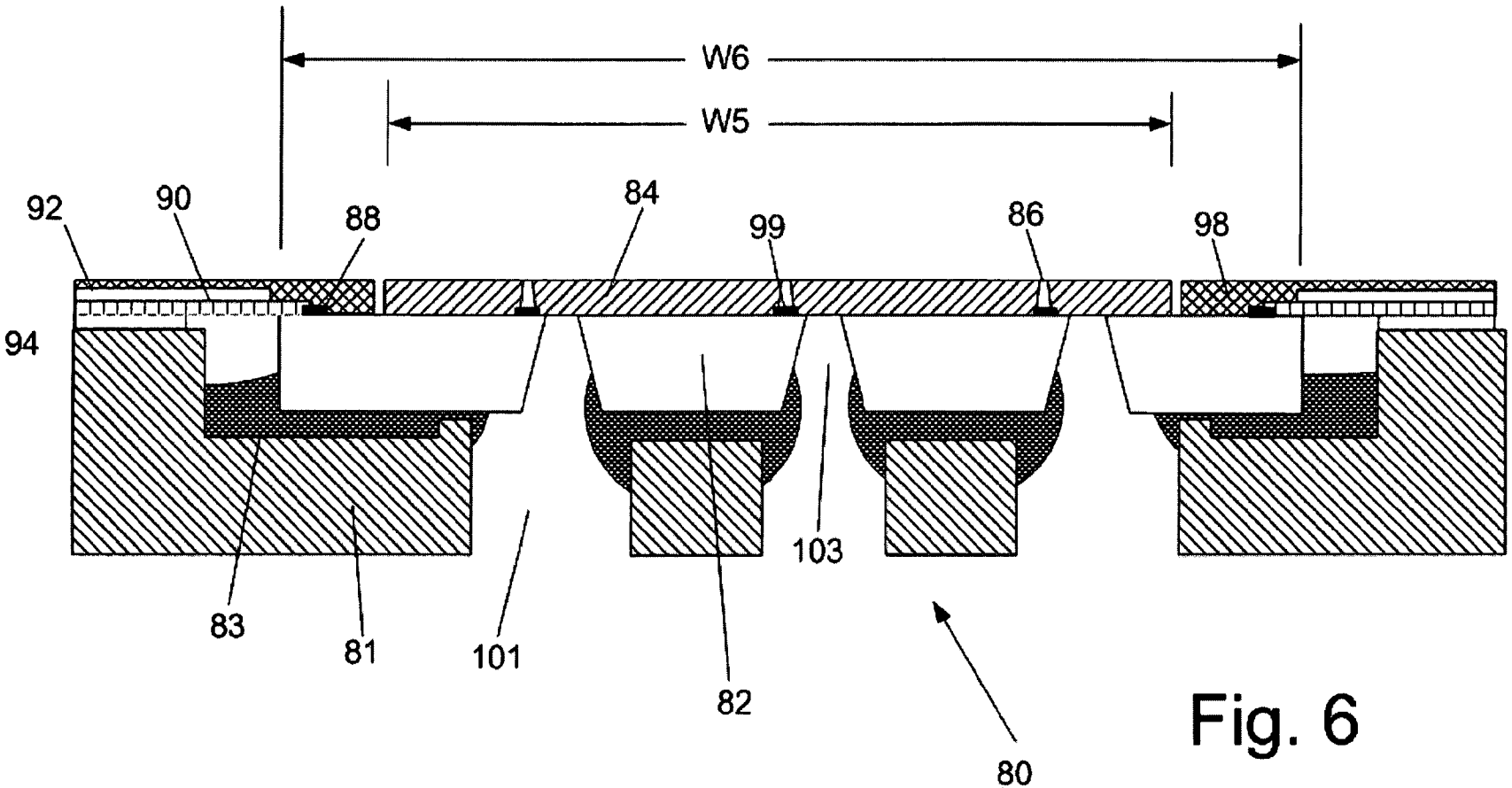
FIG. 6 is a cross-sectional view, not to scale, of a portion of a printhead according to an alternate embodiment of the invention.
Figure 7:
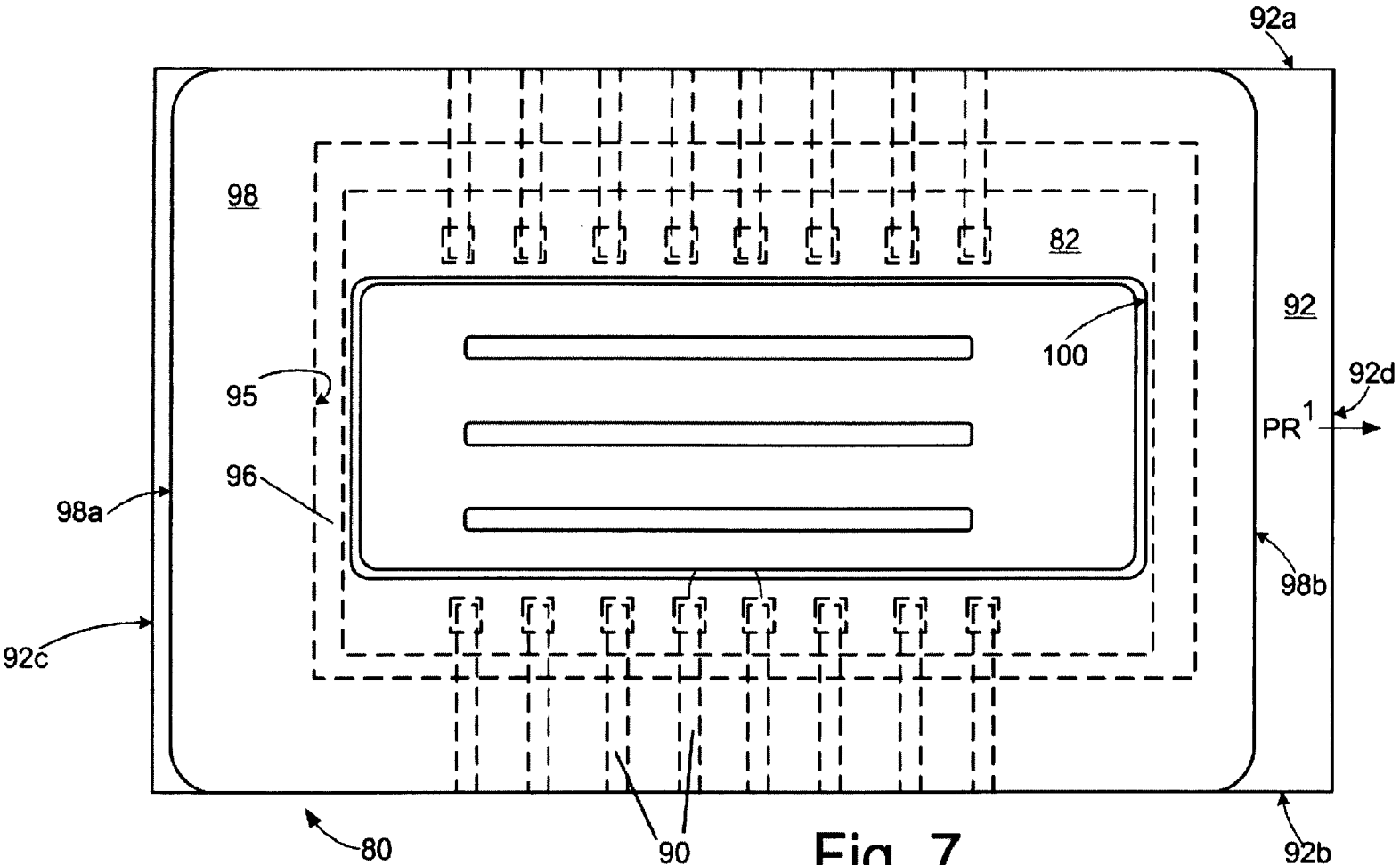
FIG. 7 is a top plan view, not to scale, of a portion of a printhead in accordance with the alternate embodiment of FIG. 6.

With reference now to FIGS. 6–7, there is shown another embodiment of a printhead 80 having a construction that protects the leads between the semiconductor substrate and the TAB circuit without requiring the use of an encapsulant. The printhead 80 is provided by a printhead body 81 having a semiconductor substrate 82 and a nozzle plate 84 attached thereto. The nozzle plate 84 is attached to the semiconductor substrate 82 using an adhesive such as a phenolic butyral adhesive to provide a substrate/nozzle assembly 82/84. The substrate/nozzle plate assembly 82/84 is attached in a chip pocket 83 in the printhead body 81, as by a die bond adhesive, to form the printhead 80. Ink is supplied to the substrate/nozzle plate assembly 82/84 from an ink reservoir in the printhead body generally opposite the chip pocket 81.

The semiconductor substrate 82 is preferably a silicon semiconductor substrate containing a plurality of ejection devices 99 such as piezoelectric devices or heater resistors formed on a device side thereof. Upon activation of the ejection devices 99, ink supplied through paths 101 in the body and corresponding vias 103 in the semiconductor substrate 82 is caused to be ejected toward a print media through nozzle holes 86 in the nozzle plate 84.

Electrical tracing extends from the ejection devices on the substrate 82 to contact pads 88 located on the surface of the substrate 82. Lead beams 90 electrically connect the contact pads 88 to a flexible circuit or a tape automated bonding (TAB) circuit 92 for supplying electrical impulses from a controller to activate one or more of the ejection devices 99 on the substrate 82. The TAB circuit 92 is attached to the printhead body 81 as by a pressure sensitive adhesive 94 and includes a cutout portion defining a window 95 for receiving the substrate 82. As the window 95 is dimensioned slightly larger than the substrate 82, a gap 96 is defined between the common edges of the substrate 82 and the inner periphery of the TAB circuit 92 defining window 95.

In this regard, and in accordance with an exemplary embodiment of the invention, the nozzle plate 84 is preferably made of a polyimide film material, such as described in connection with the nozzle plate 46, but unlike the nozzle plate 46, is conventionally sized to be slightly smaller than the substrate 82 so that it has a width W5 while the substrate width is W6. To protect the lead beams 90, a secondary plate or protection plate 98 is provided and dimensioned to extend across the gap 96 between the semiconductor substrate 82 and the TAB circuit 92. The protection plate 98 has an interior cutout portion which defines a window 100 sized to closely circumscribe the nozzle plate 84 so as to substantially overly the gap 96 and otherwise substantially cover the lead beams 90. In this regard, the window 100 is preferably sized to closely abut or overlap the outer perimeter of the nozzle plate 84, such that any gap or spacing therebetween does not exceed a width of about 100 microns. Optionally, an encapsulant may be dispensed over the juncture of the nozzle plate 84 and the protection plate 98, it being realized that the amount of encapsulant would be relatively miniscule in comparison to the amount of the encapsulant 38 used in the prior art printhead 10.

In one embodiment, the outer dimensions of the protection plate 98 may preferably be configured to extend across the portion of the gap 96 adjacent the lead beams 90 and, most preferably, the entire window or gap 96. The plate 98 is preferably dimensioned in width to substantially correspond to the width of the TAB circuit 92 and thus extend substantially to edges 92*a* and 92*b* of the TAB circuit 92. Likewise, the plate 98 is preferably dimensioned in length to have an end 98*a* which extends substantially to an end 92*c* of the TAB circuit 92. Opposite end 98*b* of the plate 98 extends closely adjacent opposite end 92*d* of the TAB circuit 92, but spaced slightly therefrom so as to not interfere with an adjoining pad region of the circuit 92, identified generally by arrow $PR^1$, which wraps over an edge of the printhead body 81 and connects to the body 81 to provide contact pads for connection to an ejector activating device such as a printer.

The thus installed protection plate 98 overlies the lead beams 90 and protects the lead beams, thereby eliminating the need for an encapsulant. Printheads utilizing the described structure also advantageously enables economy of the manufacturing process.

Figure 8:
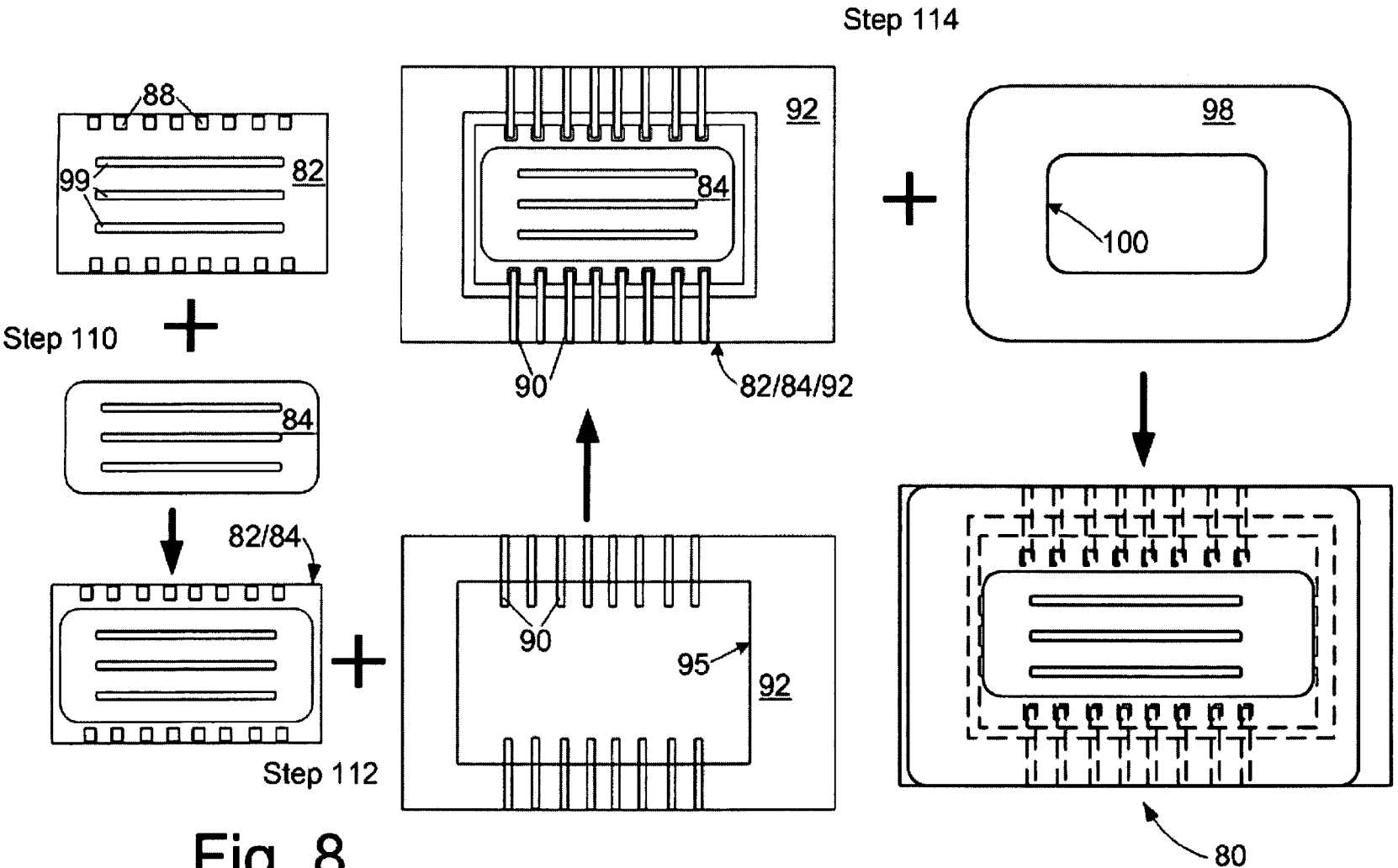
FIG. 8 illustrates steps in a manufacturing process for the printhead of FIGS. 6–7.

For example, with reference to FIG. 8, there are shown steps in the manufacture of the printhead 80, wherein the need for an encapsulant deposition step is eliminated. In a first step 10, the nozzle plate 84 is attached to the semiconductor substrate 82 to provide a substrate/nozzle assembly 82/84. In a next step 112, the assembly 82/84 is bonded to the Tab circuit 92 to provide an assembly 82/84/92. The steps up to this point correspond to conventional manufacturing steps, which, conventionally would be followed by the dispensing of an encapsulant. However, in accordance with certain embodiments of the invention, the step of dispensing an encapsulant is not necessary, as, in step 114, the protection plate 98 is bonded to the assembly using an adhesive such as phenolic butyral adhesive to provide a substrate/nozzle assembly to yield the printhead 80.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A micro-fluid ejection device, comprising:

a fluid ejection chip having a first length and a first width and having a first side and a second side, the first side including a plurality of fluid ejection actuators and a plurality of bond pads;

a flexible circuit having a first side and a second side, a window therein, and leads disposed in the window, wherein the window of the flexible circuit circumscribes the chip and each of the leads is electrically connected to corresponding bond pads on the first side of the chip through the window to supply electrical impulses to activate the fluid ejection actuators; and a nozzle plate structure containing a plurality of nozzle holes therein, the nozzle plate structure having a second length and a second width and being attached to the flexible circuit and chip, wherein the nozzle plate structure overlaps the first side of the chip and at least the leads and bond pads, wherein the nozzle plate structure is effective to retard fluid contact with the bond pads and leads in the absence of an encapsulant.

2. The device of claim 1, wherein the nozzle plate structure comprises a polyimide film.

3. The device of claim 1, wherein the nozzle plate structure comprises a nozzle plate and a protection plate circumscribing the nozzle plate.

4. The device of claim 3, wherein the protection plate comprises a polyamide material.

5. The device of claim 3, wherein the second width is greater than the first width.

6. The device of claim 5, wherein the second length is greater than the first length.

7. The device of claim 3, wherein the protection plate overlaps the first side of the chip and the leads and bond pads.

8. A printhead comprising the fluid ejection device of claim 3.

9. The printhead of claim 8, wherein the nozzle plate comprises a polyimide material.

10. A printhead comprising the fluid ejection device of claim 1.

* * * * *